US005205134A

United States Patent [19]

Gistau-Baguer

[11] Patent Number: 5,205,134

[45] Date of Patent: Apr. 27, 1993

[54] GAS LIQUEFACTION PROCESS AND REFRIGERATION PLANT

[75] Inventor: Guy Gistau-Baguer, Biviers, France

[73] Assignee: L'Air Liquide, Societe Anonyme pour l'Etude et l'Exploitation des Procedes Georges Claude, Paris, France

[21] Appl. No.: 777,139

[22] Filed: Oct. 16, 1991

[30] Foreign Application Priority Data

Oct. 26, 1990 [FR] France ..... 90 13280

[51] Int. Cl.[5] ..... F25B 7/00

[52] U.S. Cl. ..... 62/335

[58] Field of Search ..... 62/9, 11, 335, 79

[56] References Cited

U.S. PATENT DOCUMENTS

| | | | |
|---|---|---|---|
| 3,180,709 | 4/1965 | Yendall | 62/9 X |
| 3,233,418 | 2/1966 | Shaievitz | 62/9 X |
| 3,360,955 | 1/1968 | Witter | 62/335 |
| 3,613,387 | 10/1971 | Collins | 62/9 X |
| 3,864,926 | 2/1975 | Collins . | |
| 4,048,814 | 9/1977 | Quack | 62/335 |
| 4,267,701 | 5/1981 | Toscano | 62/9 X |
| 4,346,563 | 8/1982 | Hood . | |

FOREIGN PATENT DOCUMENTS

| | | |
|---|---|---|
| 0293882 | 12/1899 | European Pat. Off. . |
| 1036282 | 8/1958 | Fed. Rep. of Germany . |
| 2343211 | 9/1977 | France . |
| 1056964 | 2/1967 | United Kingdom . |

*Primary Examiner*—Alan Cohan

*Attorney, Agent, or Firm*—Young & Thompson

[57] ABSTRACT

The liquefaction process comprises the stages of precooling (3) the gas, of cooling it by heat exchange (6, 7, 8) and by fractional expansion (10, 11), under supercritical conditions, then of expanding it in a turbine (9) which delivers a volume of subcooled liquid (2). The process is especially applicable to the refrigeration of superconductive elements.

4 Claims, 2 Drawing Sheets

GAS LIQUEFACTION PROCESS AND REFRIGERATION PLANT

FIELD OF THE INVENTION

The present invention concerns a liquefaction process of a gaseous fluid having a low boiling point which comprises the stages of pre-cooling the gaseous fluid, of cooling it to a temperature near its liquefaction point, then of expanding it before collecting it in the state of at least partially liquid.

BACKGROUND OF THE INVENTION

A process of this type is described in U.S. Pat. No. 4,048,814. In the classical processes of this type, the final expansion stage is carried out by means of a valve where an isenthalpic expansion is carried out. Although the available energy in the fluid having a very low temperature is very low, it is interesting to extract it because it is available at a temperature very close to that of the liquefaction of gas.

SUMMARY OF THE INVENTION

The present invention has as an object a process which provides an increased efficiency and especially which permits a considerable reduction, with a view towards eliminating, the gaseous phase exiting the final expansion.

In order to accomplish this, according to a characteristic of the invention, the expansion is carried out in such a manner as to obtain a subcooled liquid.

According to a more particular characteristic of the invention, the expansion is carried out on the fluid in a supercritical state.

With this process, the standard properties of the fluid by means of expansion vary in a sensitive continuous manner without the problems of discontinuity between gaseous phase and liquid phase usually encountered at these temperatures. The drop in enthalpy borne by the turbine being low, its rotational speed may be low and the turbine may then function with a large margin of safety. During transitory regimes, the properties of the fluid at the entry of the turbine do not undergo important variations, and the operating conditions of the turbine are consequently not affected.

According to another characteristic of the invention, the refrigeration is carried out by at least two consecutive heat exchangers, with at least one expansion being advantageously carried out between the two heat exchanges.

The present invention has for another object to propose a refrigeration plant, of the type comprising a circuit for a low boiling point fluid including a pre-cooling stage, a cooling stage and a reservoir for liquefied gas, the cooling stage comprises at least one heat exchanger and a means for final expansion, characterized in that the final expansion means is dynamic and produces at the outlet a subcooled liquid.

The process according to the invention is particularly suitable for the operation of refrigeration plants of high power, in which case the final expansion means is advantageously a turbine. For the plants of smaller power, the turbine can be replaced by a reciprocating expansion device and, more particularly, by a reciprocating expansion piston machine having two pistons where the other piston is interposed between two heat exchangers downstream of the refrigeration stage.

BRIEF DESCRIPTION OF THE DRAWINGS

Other characteristics and advantages of the present invention will become evident from the following description of the methods of operation, given as illustrations but by no means limiting, together with the annexed drawings, wherein.

DETAILED DESCRIPTION OF THE INVENTION

Figure 1:
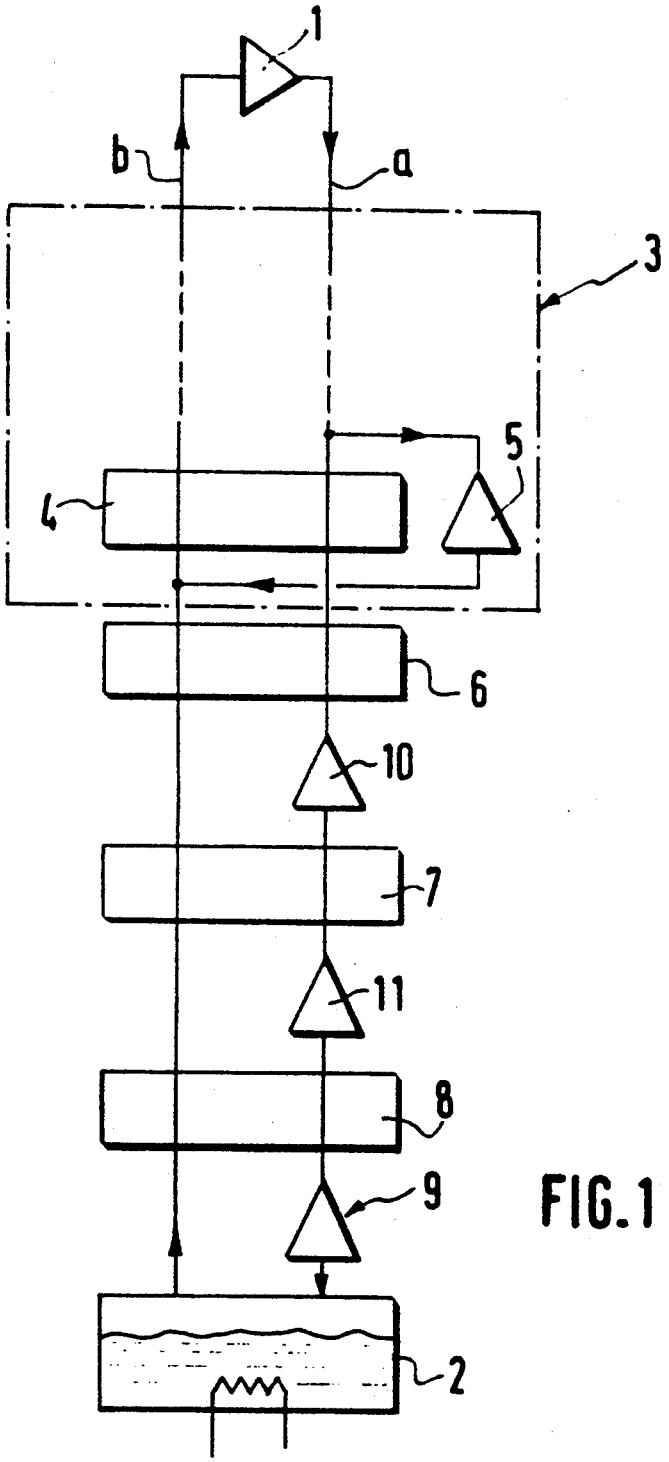
FIG. 1 is a schematic view of a first mode of operation of the refrigeration plant according to the invention.

In the description which follows and the accompanying drawings, the identical or analogous elements bear the same reference numerals.

There is seen in FIG. 1 a helium refrigeration circuit suitable for the refrigeration of superconducting cavities and comprising a compressor 1, a feed line a reservoir of liquefied gas 2, and a return line b. The plant comprises a pre-cooling stage 3 comprising a plurality of countercurrent heat exchangers disposed in series, such as at 4, associated if desired with turbines in series or in parallel, such as at 5. The pre-cooling stage 3 is followed by a refrigeration stage comprising, for example as shown in FIG. 1, three successive countercurrent heat exchangers 6, 7 and 8 traversed by the lines a and b. The final expansion stage is ensured here by a turbine 9 wherein the inlet is fed by a helium in a supercritical state at a pressure on the order of 3 to $4\times10^5$ Pa and a temperature of about 4.5 K. At the outlet of the turbine 9, the helium is obtained principally in a liquid phase and subcooled, at a pressure of about $1.3\times10^5$ Pa and at a temperature on the order of 4.4° K.

In order to guarantee the required conditions at the inlet of the turbine 9, according to one aspect of the invention, the cooled gas in the exchangers 6 and 7 is subjected to a fractional expansion by means of a first turbine 10 interposed between the two upstream exchangers 6 and 7, and of a second turbine 11 interposed between the two heat downstream exchangers 7 and 8. This arrangement allows a great increase of efficiency for the heat exchangers 7 and 8 because, the amount of expansion of the gas being fractional, the variation of temperature in each turbine is reduced and, consequently, the variation of the cold end of the adjacent exchanger is equally reduced. The cut-off temperature of the cold end being raised, this permits a reduction of fluid flow passing in the pre-cooling stage. The efficiency of the liquefaction in the expansion turbine 9 additionally allows the reduction of circulating fluid flow in the cold end. The reduction of these two flows especially permits the improvement of the overall efficiency of the circuit. As an indicative value, the gas temperature in the conduit a at the exit of the pre-cooling stage 3 is on the order of 20° K. and at a pressure between 5 and $18\times10^5$ Pa, the two turbines 10 and 11 bringing back this pressure at the entrance of the downstream heat exchanger 8 to about $4\times10^5$ Pa. As seen above, in the reservoir 2, the liquid helium is available at a pressure on the order of 1.2 to $1.3\times10^5$ Pa and at a temperature of 4.4° K.

Figure 2:
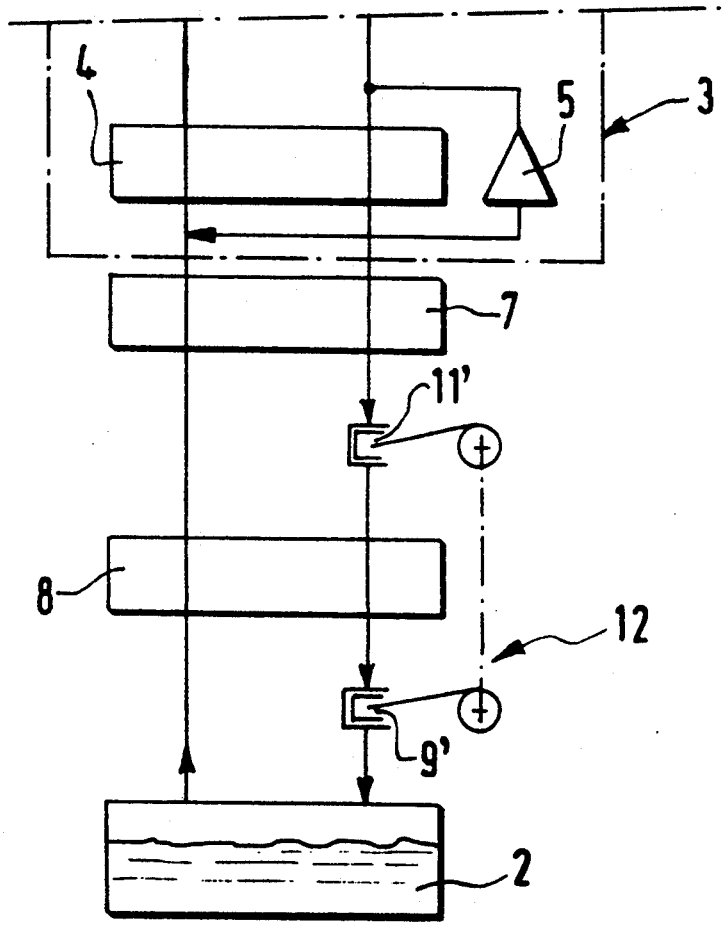
FIG. 2 is a schematic view, analogous to the preceding one, of a modification of the method of operation.

In the embodiment of FIG. 2, more particularly suitable to plants of medium power, the turbine 9 is replaced by one of the cylinder-piston assemblies 11' of a reciprocating expander having two pistons 12 wherein the other piston, mechanically connected in opposite phase to piston 11', is interposed between the two exchangers 7 and 8, instead of the downstream turbine 11 of the preceding embodiment.

The invention is not limited to the described embodiments and is subject to various modifications and variations which fulfill the same object. In particular, the downstream turbine 11 may be placed in a derivative loop of the line a, bypassing downstream exchanger 8 and including exchanger 7.

I claim:

1. A refrigeration plant having a cooling circuit of a fluid having a low boiling point comprising, serially arranged:

a pre-cooling stage, a refrigeration stage comprising, in series, a first heat exchanger, a first turbine, a second heat exchanger, a second turbine, and a third heat exchanger, a downstream dynamic expansion device, and a liquid fluid reservoir.

2. The plant of claim 1, wherein the downstream dynamic expansion device is a turbine.

3. The plant of claim 2, having a heating circuit leading from the reservoir through the refrigeration stage and the pre-cooling stage, wherein the pre-cooling stage comprises a downstream heat exchanger and a turbine by-passing part of the fluid in the cooling circuit before it reaches the downstream heat exchanger.

4. The plant of claim 1, wherein the downstream dynamic expansion device is comprised of a cylinder and piston assembly of a two-piston reciprocating expansion machine.

* * * * *